United States Patent [19]

Hanson

[11] 4,180,718

[45] Dec. 25, 1979

[54] APPARATUS AND SYSTEM FOR PROCESSING OIL SHALE

[76] Inventor: Lester Hanson, 1903 Princeton Ave., Salt Lake City, Utah 84108

[21] Appl. No.: 847,058

[22] Filed: Oct. 31, 1977

Related U.S. Application Data

[62] Division of Ser. No. 721,946, Sep. 10, 1976, Pat. No. 4,065,361.

[51] Int. Cl.[2] ..... H05B 9/06

[52] U.S. Cl. ..... 219/10.55 A; 219/10.55 R; 432/134; 198/952; 34/164

[58] Field of Search ..... 219/10.55 A, 10.55 R, 219/10.69, 10.71; 198/820, 844, 752, 771, 952; 432/134; 34/164

[56] References Cited

U.S. PATENT DOCUMENTS

| | | | |
|---|---|---|---|
| 2,090,873 | 8/1937 | Lazarus | 126/247 |
| 2,343,337 | 3/1944 | Somes | 432/134 |
| 3,177,333 | 4/1965 | Lamb | 219/10.55 A |
| 3,179,239 | 4/1965 | Wulf | 198/820 |
| 3,261,959 | 7/1966 | Connell et al. | 219/10.55 A |
| 3,374,553 | 3/1968 | Gillman | 34/164 |
| 3,665,141 | 5/1972 | Schiffmann et al. | 219/10.55 A |
| 3,836,743 | 9/1974 | Wardwell et al. | 219/10.69 |
| 3,974,354 | 8/1976 | Long | 219/10.55 E |
| 4,003,774 | 1/1977 | Lebet et al. | 219/10.55 A |

FOREIGN PATENT DOCUMENTS

| | | | |
|---|---|---|---|
| 473865 | 5/1951 | Canada | 219/10.71 |
| 1502262 | 3/1978 | United Kingdom | 219/10.55 A |

*Primary Examiner*—Bruce A. Reynolds
*Assistant Examiner*—Philip H. Leung
*Attorney, Agent, or Firm*—M. Ralph Shaffer

[57] ABSTRACT

Apparatus for treating oil shale by microwave energy for recovering heated volatile fractions thereof. The microwave oven includes a sloping feeder made of glass, pyrex, or ceramic material, which feeder is reciprocated back and forth along a declining plane so as to advance slowly but progressively oil shale deposited on the top end thereof to the discharge end of the vibrator. Means are provided to evacuate volatile fractions and to feed such gases through preheater tubes to a condenser unit. The preheater tubes are disposed in line with and through the flow of incoming materials so as to tend to regulate material descent as well as preheat the shale. An additional solids heat exchanger is employed underneath the discharge end of the vibratory feeder means so as to slow the descent of the spent shale onto its ultimate conveyor as well as taking heat therefrom and from magnetron tubes of the oven to conduct such heat upwardly to further increase the preheating effect upon incoming shale. Condenser units are employed and a prime mover-generator unit are used to utilize a portion of the recovery for ultimately powering such magnetron tubes to produce the electro-magnetic wave energy necessary to heat the shale and vaporize its bituminous constituents.

9 Claims, 5 Drawing Figures

APPARATUS AND SYSTEM FOR PROCESSING OIL SHALE

This is a division of application Ser. No. 721,946, filed Sept. 10, 1976, now U.S. Pat. No. 4,065,361.

FIELD OF INVENTION

The present invention relates to subjecting ore or shale to microwave energy and vacuum means for recovering vaporized bituminous fractions, condensing a portion of such fractions, and, more particularly, to a new and improved structure including new microwave oven means wherein a continuous throughput and continuous treatment are rendered possible.

DESCRIPTION OF PRIOR ART

The following United States and foreign patents are known which deal with the subject area, as follows:

| U.S. Pat. No. | |
|---|---|
| 773,139 | 3,330,405 |
| 1,548,307 | 3,377,266 |
| 1,957,347 | 3,449,213 |
| 2,597,345 | 3,503,865 |
| 2,542,028 | 3,547,803 |
| 2,573,906 | 3,560,347 |
| 2,809,154 | 3,644,194 |
| 2,825,677 | 3,652,447 |
| 2,903,407 | 3,660,268 |
| 3,110,652 | 3,843,457 |
| **Foreign Patent No.** | **Country** |
| 2843 | Netherlands |
| 629,047 | Canada |

BRIEF SUMMARY OF THE INVENTION

According to the invention a microwave oven is provided with continuous throughput structure taking the form of a vibratory feeder type conveyor which is oscillated back and forth in a declining plane orientation to advance materials through the oven. Evacuation means are used to produce a negative pressure inside the oven and for withdrawing vaporized products of such microwave treatment. Heat from the magnetron tubes supplying microwave energy into the oven to the oil shale is withdrawn and conveyed proximate the spent shale area to both increase final combustion thereof and also to combine with heat thereat for routing back to a preheat region proximate the hopper of the system.

Cooling of vapors and gases withdrawn from the oven are likewise passed through preheater tubes proximate the hopper for incoming ore, whereby incoming ore or shale can be preheated prior to its deposit at the elevated head end of the vibratory feeder conveyor used.

Metal supports are employed for the feeder conveyor both for purposes of strength and support and also to reflect back into the oven any microwave energy that tends to proceed through ports in the oven structure providing passage for the reciprocating conveyor. The conveyor trough itself includes depending ribs used for purposes of strength and also as cooling fins, to keep the glass or ceramic conveyor member as cool as possible and hence less likely to fracture. Vibrating means such as a standard electro-magnetic vibratory-conveyor reciprocator is utilized to reciprocate the vibratory feeder within the oven structure. A portion of the output of the system is fed back into the input power system to supply electrical energy to the magnetron tubes utilized.

OBJECTS

Accordingly, a principal object of the invention is to provide a new and improved microwave apparatus for processing crushed oil shale to recover vaporized products therefrom.

A further object is to provide a practical microwave oven including vibratory means for rendering possible a continuous throughput from such oven.

An additional object is to provide means for preheating oil shale to be introduced into the oven.

A further object is to provide means for condensing vaporized products from the microwave plant herein and also for utilizing a portion of the output to supply energy to the magnetron tubes provided.

A further object is to provide a new and improved conveyor in microwave oven structure.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

BRIEF DESCRIPTION OF THE DRAWINGS

In FIG. 1 the hopper 10 is designed to receive incoming crushed oil shale and is disposed in registry with the upper portion 12 of solids heat exchanger 13, see FIG. 2. The heat exchanger consists generally of a box 14 which is open top and bottom and is provided with a series of longitudinal and transverse heat exchanger tubes 15 and 16. Such tubes are set in apertures 17 and 18 and communicate with manifolds 19, 20 and also 21, 22, as indicated. Conduits 23 and 24 are thus interconnected by this series of tubes 15 so that flow proceeds from arrow 25 to arrow 26. Conduit 27 and conduit 28 are likewise disposed in communication by their respective manifolds 21 and 22 and a series of tubes 16 which interiorly communicate with the interior of the manifold structures at 21 and 22. Accordingly, there is a gas flow path from arrow 29 and arrow 30, to arrows 31 and 32.

Figure 1:
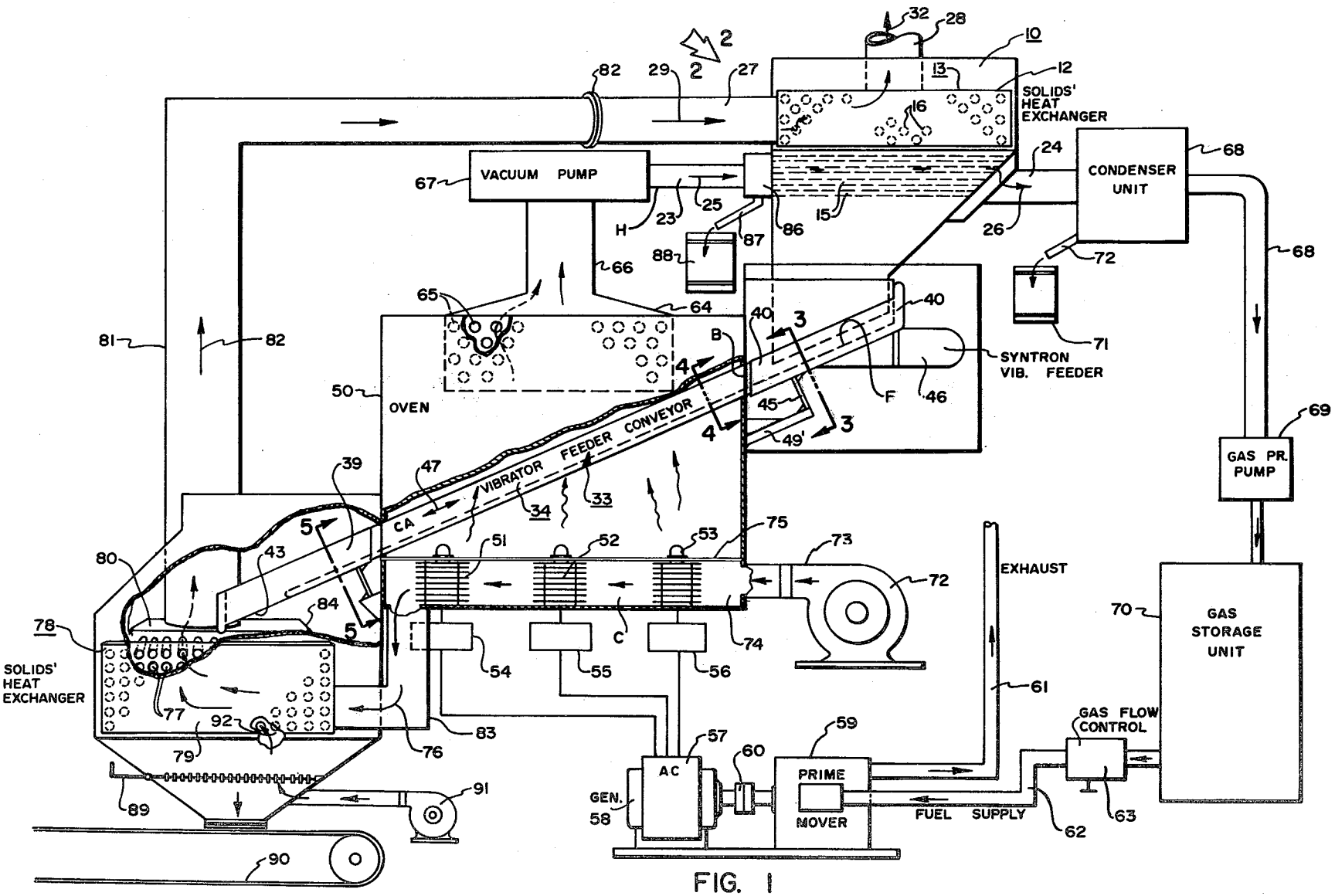
FIG. 1 is a side elevation, shown partially cut-away and in schematic form, of a microwave system for treating oil shale according to the principles of the invention.

In operation as to this portion of the structure, the series of tubes 16 and 15 in FIG. 2 serve to retard the flow of feedstock appropriately for feeding the vibratory feeder conveyor 33 hereinafter described, and also permits a heat exchange to occur as between the tubes 15 and the tubes 16 relative to the incoming ore. Such heat is thus supplied by the hot gases proceeding through conduit 23 and conduit 27 in FIG. 1, see also FIG. 2. Accordingly, the solids heat exchanger 13 serves to preheat the ore prior to its descent onto the vibratory feeder conveyor 33.

Figure 4:
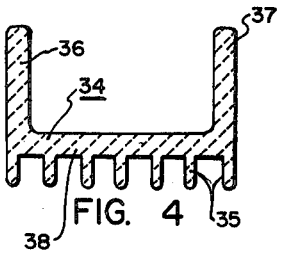
FIG. 4 is an enlarged fragmentary section taken along the line 4—4 in FIG. 1.
Figure 5:
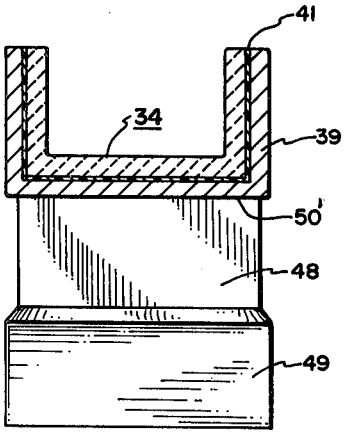
FIG. 5 is an enlarged transverse section taken along the line 5—5 of FIG. 1.

As to the latter, feeder conveyor 33 includes a conveyor trough member 34 that may be made of glass, pyrex, or clay material, or other ceramic material, see FIG. 4. All of such materials shall be considered "ceramic". The conveyor trough member preferably includes a series of fins or ribs 35 that extend in a direction reverse to the upstanding sides 36 and 37. Accordingly, the fins or ribs depend from base 38 of the conveyor trough member 34. These ribs or fins 35 will extend between the electromagnetically reflective steel frame 39 and 40 facing the oven and which seat seat the conveyor trough member 34 at asbestos liners 41 and 42. Relative to steel frame 39, the same will be provided with an aperture or open end at 43 to accommodate the downward movement of ore dropped therethrough after traversing the vibratory feeder conveyor 33. Plate 44 includes a spring steel flange or web 45 that is attached to the steel frame 40 and is thin enough to permit an oscillatory movement as supplied by Syntron vibratory feeder 46 which is coupled and attached to the steel frame 40. Accordingly, member 45 serves as a spring finger, in effect, which carries or oscillates back and forth the steel frame 40 and the vibratory feeder conveyor carried thereby. Syntron vibratory feeder 46 may comprise any one of several heavy-duty electromagnetic feeders manufactured by the FMC Corporation of the United States, see its bulletin 152372, also bulletin 141872. Model F-450 thereof, a heavy duty unit, can be used at 46 to convey up to 500 tons of material per hour. A model F-330 may convey up to 110 tons per hour. These are merely examples of the reciprocating means by which the vibratory feeder conveyor can be reciprocated back and forth, in its angulated condition in the direction of arrow 47 so as to convey material from the upper righthand end of the feeder down to the aperture 43 in frame 39.

In the latter regard the steel frame at 39 may likewise be carried by a flange type finger 48 which is supported by structure 49. Finger 48 is constructed to oscillate back and forth at its upper edge 50' to accommodate the vibratory movement of the feeder conveyor 33 as produced by electromagnetic vibrating unit 46. Oven support structure 49' mounts finger 45.

In operation as to this part of the structure, ore passing through the heat exchanger above alights on the feed end F of the vibratory feeder conveyor 33 and particularly the conveyor trough member 34 thereof. The vibrations of the feeder conveyor 33, in its angulated condition, produces a progressive downward travel of the ore so that the same can be heated during such transit through oven 50 before finally being exhausted from the conveyor at opening or port 43 at the lower left portion of FIG. 1.

A manner of heating such ore is provided by microwave energy emanating from magnetron tubes 51, 52 and 53 which may be found in any conventional domestic microwave oven found currently on the market and manufactured by a number of manufacturers such as Litton Industries, The Amana Corporation, and so forth. Microwave power units 54, 55 and 56 are strictly conventional and coupled to AC panel 57 of generator 58. Generator 58 is driven by prime mover 59, being coupled thereto by coupling shaft unit 60 of conventional form. The prime mover, being an internal combustion engine, gas turbine, or any other conventional prime mover, will include an exhaust stack 61 and also a fuel supply conduit 62 leading from gas flow control 63. This may comprise a manual control for regulating gas fuel flow to the prime mover 59. The prime mover may be any type of internal combustion engine or other means, generally receiving some type of gaseous or liquid fuel to produce power for converting such power to electrical energy at panel 57.

In attending to a consideration of the oven 50, it is seen that the manifold 64 receives gases generated in the oven since such gases will come into the manifold at the series of side perforations 65 of such oven. Perforations 65 preferably should not be larger than ⅛ inches in diameter, for proper oven-entrapment of microwave energy. Manifold 64 includes a stack 66 leading to vacuum pump unit 67. The gases sent upwardly by the vacuum pump 67 are routed through conduit 23 and through conventional condenser unit 86 which may simply comprise a manifold communicating with the series of heat exhaust tubes 15 leading to conduit 24.

Likewise important is the provision of a pair of heat exchangers, one proximate the hopper 10 at the input side of the equipment, and the other at 78, at the spent shale area of the equipment. It is noted that the heat exchanger in both cases serves as a flow-retarding grate and also as a means whereby hot gases may be used to heat incoming ore prior to its deposit on the vibratory feeder conveyor used.

If desired, an initial conventional unit at 86 having down-spout 87 may be supplied for collecting and conveying initial droplets of oil into collector 88.

Accordingly, what is provided is a microwave operated system wherein the apparatus employs a vibrating-type ceramic or glass conveyor, this for ensuring a continuous throughput of material through the microwave oven employed. Solids heat exchanger means are used at both the input and discharge ends relative to the ore so as to preheat incoming oil shale prior to its treatment on the vibratory feeder conveyor employed.

Figure 2:
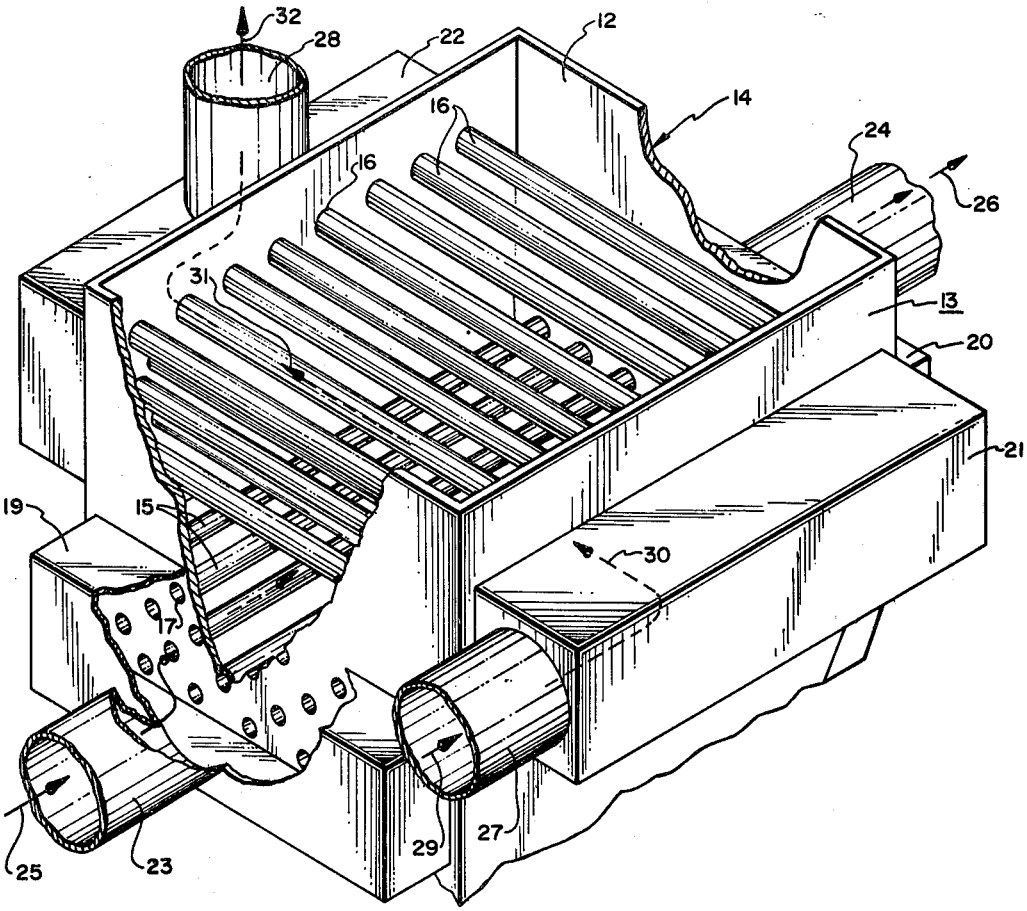
FIG. 2 is an enlarged perspective, partially broken away, of a heat exchanger utilized proximate the hopper structure of the system, and is taken along the arrow 2—2 in FIG. 1.
Figure 3:
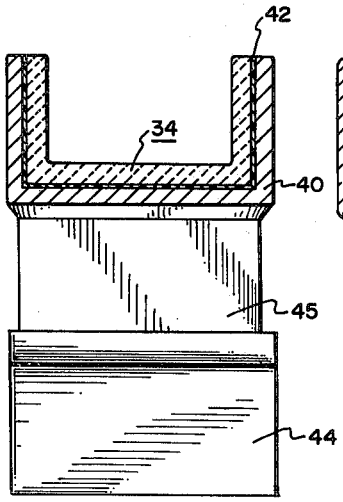
FIG. 3 is an enlarged transverse section taken along the line 3—3 in FIG. 1.

If desired, a reciprocating grate 89 may be employed to loosen the descending spent shale in the unit preparatory to dropping down onto endless conveyor 90 in FIG. 1, or truck, to be disposed of.

As seen at the lower lefthand portion of FIG. 1, the heat exchanger 78 is provided with opposite manifolds 79 and 80 interconnecting the heat exchanger tubes 77. Heated air currents at 76 are routed through such tubes to conduit 81 leading through coupler 82 and conduit 27 to the tubes 16, heat exchanger 10 and from thence rise in exhaust stack 28.

Air blower 91 may be installed as shown, to add oxygen to the spent shale to further heat the same and to enter the manifold 79 at opening 92.

While particular embodiments of the invention have been shown and described, it will be obvious to those skilled in the art the various changes and modifications which may be made without departing from the essential features of the present invention and, therefore, the aim in the appended claims is to cover all such changes and modifications as fall within the true spirit and scope of the invention.

I claim:

1. In combination, an oil-shale processing microwave oven having opposed openings, a reciprocating conveyor having a feed end and a discharge end and disposed in and through said oven at said openings, said conveyor sloping downwardly from said feed end to said discharge end and comprising a rigid, unitary, homogeneous, ceramic, elongate, vibrating member and a pair of metallic supports facing said openings, receiving opposite ends of said vibrating member, and supportingly connected to said oven, and means for vibrating said member coupled thereto, and wherein said vibrating member comprises an upwardly open channel having vertically depending structural cooling fins disposed solely between said supports.

2. An oil-shale processing microwave oven having a rigid, unitary, elongate, ceramic conveyor, having a feed end and a discharge end, downwardly sloping along its elongate dimension, means for vibrating said conveyor coupled thereto, said conveyor having vertically depending structural cooling fin means and being transversely concave upwardly to provide an upwardly concave conveyor trough, and means for movably supporting said conveyor beyond said fin means.

3. The structure of claim 2 wherein said movably supporting means of said microwave oven comprises metallic frames supporting opposite ends of said conveyor.

4. The structure of claim 3 wherein said conveyor includes, as said cooling fin means, elongate, vertically depending ribs intermediate said frames.

5. The structure of claim 3 wherein said vibrating means is coupled to at least one of said frames.

6. The structure of claim 3 wherein said frames include end portions reflectively facing toward the interior of said microwave oven.

7. The structure of claim 3 wherein said vibrating means are movably coupled to at least one of said frames.

8. The structure of claim 3 wherein said conveyor has a feed end and a discharge end, is angulated downwardly from said feed end to said discharge end, and includes a lower end interiorly contoured, with its respective one of said frames, to provide thereat an interior discharge aperture for discharging spent materials thereat.

9. The structure of claim 3 wherein said frames include insulation means contacting said conveyor.

* * * * *